US007667667B2

(12) United States Patent
Kimura et al.

(10) Patent No.: US 7,667,667 B2
(45) Date of Patent: Feb. 23, 2010

(54) RADIO WAVE LENS ANTENNA APPARATUS

(75) Inventors: Koichi Kimura, Osaka (JP); Masatoshi Kuroda, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 251 days.

(21) Appl. No.: 11/921,414

(22) PCT Filed: Jun. 2, 2005

(86) PCT No.: PCT/JP2005/010176

§ 371 (c)(1),
(2), (4) Date: Nov. 30, 2007

(87) PCT Pub. No.: WO2006/129365

PCT Pub. Date: Dec. 7, 2006

(65) Prior Publication Data

US 2009/0207095 A1 Aug. 20, 2009

(51) Int. Cl.
*H01Q 15/08* (2006.01)

(52) U.S. Cl. ..... 343/911 L; 343/911 R

(58) Field of Classification Search ..... 343/911 L, 343/911 R

See application file for complete search history.

(56) References Cited

U.S. PATENT DOCUMENTS

| | | | | |
|---|---|---|---|---|
| 6,462,717 | B1 * | 10/2002 | Wheelock et al. | 343/872 |
| 7,253,789 | B2 * | 8/2007 | Kingsley et al. | 343/911 R |
| 2002/0024477 | A1 * | 2/2002 | Foncin | 343/909 |
| 2006/0262031 | A1 * | 11/2006 | Kuroda et al. | 343/911 R |
| 2007/0035468 | A1 | 2/2007 | Kuroda et al. | |

FOREIGN PATENT DOCUMENTS

| | | |
|---|---|---|
| JP | 3-70409 | 7/1991 |
| JP | 6-021714 | 1/1994 |
| JP | 9-223910 | 8/1997 |
| JP | 2002-232230 | 8/2002 |
| JP | 2005-51657 | 2/2005 |
| JP | 2005-167692 | 6/2005 |

* cited by examiner

*Primary Examiner*—HoangAnh T Le
(74) *Attorney, Agent, or Firm*—McDermott Will & Emery LLP

(57) ABSTRACT

In a radio wave lens antenna, a lens cover for covering the surface of the lens is stably fixed to the reflector. The antenna has a semispherical Luneberg lens, a semispherical shell-shaped lens cover for covering the surface of the lens, a radio wave reflector, a ring-shaped plate placed along the outer circumference of the lens, a primary feed placed at the focal point of the lens, and a holding part for the primary feed. A flange provided at the opening edge of the lens cover is clamped by the reflector and the plate to fix the lens cover to the reflector, and more preferably, the lens cover is caused to be in contact with the lens, and the lens is pressed also in the radial direction by the plate via the lens cover.

20 Claims, 7 Drawing Sheets

RADIO WAVE LENS ANTENNA APPARATUS

RELATED APPLICATIONS

This application is the U.S. National Phase under 35 U.S.C. §371 of International Application No. PCT/JP2005/010176, filed on Jun. 2, 2005, the disclosures of which Application is incorporated by reference herein.

FIELD OF THE INVENTION

The present invention relates to a radio wave lens antenna adopting a Luneberg lens used for receiving and transmitting radio wave from and to communications satellites, antennae installed on the ground and the like.

BACKGROUND OF THE INVENTION

As a radio wave lens for an antenna device, there is known one that uses a Luneberg lens. The Luneberg lens is a spherical lens made of dielectric material, wherein the relative dielectric constant varies within a range from 2 to 1 or its approximate value from the center of the sphere to the outer periphery. Further, there is another type of Luneberg lens that achieves the function equivalent to that of the spherical lens by combining a hemispherical lens with a radio wave reflector having a greater size than the hemispherical lens (see, e.g., Patent Document 1).

Since the radio wave lens antenna disclosed in Patent Document 1 uses a hemispherical lens, and therefore, the size can be reduced and the cost can be saved compared to the case of using a spherical lens. However, since it is configured such that its entire parts are covered with a radome for protection, the size becomes large. Further, and the radome of a hollow structure must have a large thickness to secure a sufficient strength, which causes problems in electric characteristics and an increase in cost.

Regarding this, in the radio wave lens antenna of the structure disclosed in Patent Document 1, a lens cover of a hemispherical shell shape may be used such that the lens is sealed by the lens cover and a reflector. Since the lens cover is in contact with the surface of the lens, the size and the thickness can be made smaller. Thus, a further reduction in size can be achieved, and desirable electric characteristics can be acquired more easily compared to the antenna that uses a radome.

However, Patent Document 1 does not mention anything about the fixing and liquid sealing of the lens. The lens is usually fixed to the reflector by using an adhesive. However, the adhesive may be deteriorated after a long period of use, and thus the lens may be detached therefrom. Also, the lens may be removed due to an impact, wind pressure, bending of the reflector by vibration, or the like. In this case, a gap in which the dielectric constant differs from that of the lens may be formed between the lens and the reflector, thereby greatly degrading the electrical performance of the antenna device. Furthermore, when the adhered portion is peeled off while the lens cover is misaligned or damaged, there is a risk of the lens falling down.

Further, if the reflector is not properly sealed to the lens cover, rainwater, moisture or the like may penetrate the inside of the lens cover. Since water has a high dielectric constant ($\in r$) and a high dielectric loss (tan $\delta$), merely a slight amount of moisture that has seeped into the lens may sharply degrade the electrical performance of the antenna device. However, Patent Document 1 does not disclose any solution to these problems.

Patent Document 1: Japanese Patent Application Publication No. 2002-232230

SUMMARY OF THE INVENTION

It is an object of the present invention to provide a radio wave lens antenna configured such that the electrical performance is not degraded and the lens does not fall down even if the adhesive between the lens and the reflector peels off, and water or moisture does not easily permeate into the lens cover.

To achieve the above object, in accordance with the present invention, a flange is formed at an opening edge of a lens cover, and arranged between a reflector and a plate that encircles a lens to fix the lens cover to the reflector. Further, a sealing is performed between the reflector and the lens cover is provided on a circumference centered at a center of the lens and having a diameter greater than that of the lens, and the plate is fixed to the reflector at a position located farther from the lens than the sealing part.

More specifically, in a radio wave lens antenna including a hemispherical Luneberg lens, a lens cover that covers the surface of the lens, a reflector for radio wave combined with the lens, a ring-shaped plate arranged along an outer circumference of the lens, a primary feed arranged at a focal point of the lens, and a holding part for the primary feed, the lens cover is fixed by arranging a flange formed at an opening edge thereof between the reflector and the plate, a sealing part that seals between the reflector and the flange is provided on a circumference centered at a center of the lens and having a diameter greater than that of the lens, and the plate is fixed to the reflector at a position located farther from the lens than the sealing part.

The plate may be divided into two or more parts in a circumferential direction. Particularly in case an inner peripheral surface of the plate has a part where an inner diameter thereof is smaller than an outer diameter of the lens cover, it is preferable to install the plate by dividing it into two or more parts.

A part of the lens cover may be brought in contact (preferably, a pressed contact) with the lens to have the lens fixed. In this case, the position of the contacting part between the lens and the lens cover is not particularly limited. However, when the lens cover is broken, the probability that a part of the lens cover survives is higher at a region closer to the surface of the reflector. Therefore, it is preferable that the lens cover is in contact with the lens at a region close to the reflector.

An inner peripheral surface of the plate may be sloped in a direction that a separation gap from the lens increases as moving towards a lower surface of the plate, such that a part where an inner diameter thereof is smaller than the outer diameter of the lens cover is formed at an upper portion or a central portion of the inner peripheral surface of the plate in the thickness direction, thereby fixing the lens to the lens cover by using the plate configured as such. Further, the inner peripheral surface of the plate may have a recessed or a projected portion recessed or projected in a direction of a lens diameter, such that the inner peripheral surface of the plate is fittedly inserted to the lens cover.

In an installation part of the plate, a reflection surface for radio wave may be provided by the upper surface of the plate. In case of using the upper surface of the plate as a part of the radio wave reflection surface, it is preferable that a step height between the reflection surface of the reflector and the upper surface of the plate is made as small as possible. It is preferable that the thickness of the plate is smaller than or equal to 1/10 of the wavelength of a received radio wave.

Further, it is also preferable to provide a structure in which the upper surface of the plate is maintained to be flat by clamping the plate to the reflector by a flat head screw; a structure in which the plate is formed of synthetic resin having a low dielectric loss and the reflection surface of the reflector is placed under the plate; and a structure in which the plate is buried in the reflector to reduce the step height between the plate and the reflector. In case of burying the plate in the reflector, the height of the upper surface of the plate can be aligned in the same plane as the reflection surface of the reflector.

Further, the plate may be formed of synthetic resin (including foam resin). The synthetic resin used as the material of the plate may preferably be polyolefin resin whose dielectric loss is small, such as polyethylene, polypropylene and polystyrene; or fluorine resin such as polytetrafluoroethylene.

Further, although the sealing between the lens cover and the reflector may be performed only by forming a flange therebetween, it would be more preferable that any of an O-ring, a packing, a sealant, and an adhesive are used for the sealing separately or in combination.

It is also preferable that the opening edge of the lens cover, together with the flange formed thereat, is inserted into the reflector, and the sealing between the lens cover and the reflector is carried out within the reflector.

It is also considerable that the reflector includes a first reflector on which the lens is mounted and a second reflector covering a part of the first reflector that encircles the lens, and the second reflector is also used as the plate. In this case, the overlapping part of the first and the second reflector can be regarded as an inside of the reflector so that the sealing part between the lens cover and the reflector is formed at the overlapping part.

In accordance with the radio wave lens antenna of the present invention, a flange is disposed at an opening edge of a lens cover between a ring-shaped plate and a reflector, so that the lens cover is fixed to the reflector. Thus, a clamping pressure is applied uniformly to each part of the flange, thereby preventing the thin lens cover from being damaged by a weight load concentrated on a part thereof.

In addition, the flange of the lens cover is uniformly pressed by a plate such that a sealing pressure is applied uniformly to a sealing part between the flange and the reflector. Thus, the reliability of sealing can be enhanced by a uniform sealing. Also, by fixing the plate at a position located more outwards in the direction of the lens diameter than the sealing part, water can be prevented from penetrating through the fixing portion of the plate.

Further, by dividing the plate into two or more parts in the circumferential direction, it is possible to make the lens cover pressed by the plate in the diametrical direction, and the lens can be located between the divided parts of the plate via the lens cover. Thus, falling-down of the lens can be prevented more effectively.

Further, the inner peripheral surface of the plate is sloped such that the inner diameter of the upper portion of the inner peripheral surface or the central portion of the plate in the thickness direction is made smaller than the outer diameter of the lens cover; or one or more projections are formed on the inner peripheral surface of the plate in the direction of the lens diameter such that the projections of the inner peripheral surface are fittedly inserted into corresponding portions of the lens cover. Thus, the plate is fixedly engaged with the lens cover such that, even when the adhesive is loosened, the lens remains fixed to the plate. Therefore, a displacement or falling-down of the lens does not occur easily.

In case of performing the sealing between the lens cover and the reflector within the reflector, it is possible not to dispose a component that influences the reflection of radio wave on the reflection surface of the reflector. With this structure, the radio wave is reflected in a normal manner over the entire parts of the reflection surface, so that the electrical performance of the antenna apparatus can be maintained without being degraded.

Further, by performing the sealing within the reflector, the antenna cover is prevented from being detached from the reflector, and a non-uniformity of sealing pressure at the sealing part is eliminated. Thus, the stability of sealing can be enhanced.

In case the flange at the opening edge of the antenna cover is arranged between the first and the second reflector to be fixed thereto, the sealability can be achieved by such an arrangement.

Further, in case the flange at the opening edge of the lens cover is arranged on the reflection surface of the reflector to perform the sealing, if a projected or recessed portion is formed as a stepped portion or hole (such as a water drainage hole) at the overlapped portion of the flange on the reflector, a gap is formed between the flange and the reflector by the projected or recessed portion, thereby making it difficult to perform a satisfactory sealing. However, this problem does not occur if the sealing is performed within the reflector.

Besides, in case the sealing is performed by using an O-ring, a packing, a sealant, an adhesive or the like separately or in combination, a more stable sealing can be achieved.

DESCRIPTIONS OF REFERENCE SYMBOLS

Figure 1:
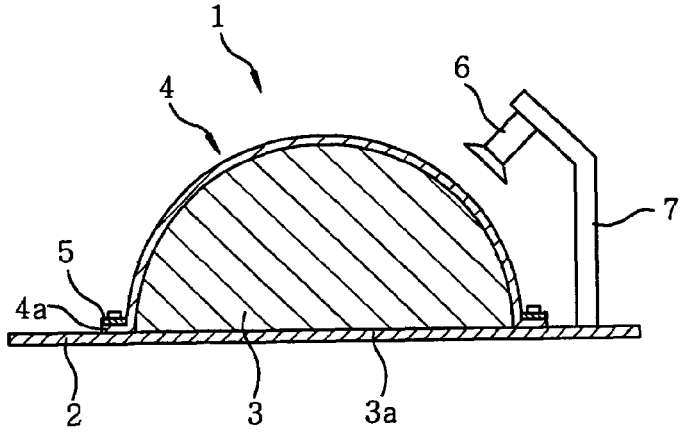
FIG. 1 is a cross sectional view showing the outline of an example of a radio wave lens antenna in accordance with the present invention.

1 radio wave lens antenna
2 reflector
2*a* groove
2*b* first reflector
2*c* second reflector
3 Luneberg lens
3*a* fixing surface
4 lens cover
4*a* flange
5, 15 plate
6 primary feed
7 holding part
8 sealing part
8*a* sealing agent
8*b* O-ring
9 clamping part
10 adhesive
11 protrusion
12 groove
15*a* lower plate
15*b* upper plate

DETAILED DESCRIPTION OF THE EMBODIMENTS

Hereinafter, embodiments of a radio wave lens antenna in accordance with the present invention will be described with reference to FIGS. 1 to 12. FIG. 1 shows a schematic cross section of a radio wave lens antenna after being assembled. The radio wave lens antenna 1 includes a reflector 2 for reflecting radio waves; a hemispherical Luneberg lens 3 (hereinafter, simply referred to as "lens") installed on the reflector 2; a hemispherical shell-shaped lens cover 4 that covers the surface of the lens; a ring-shaped plate 5; a primary feed 6 placed at a focal point of the lens; and a holding part 7 of the primary feed 6.

Figure 2:
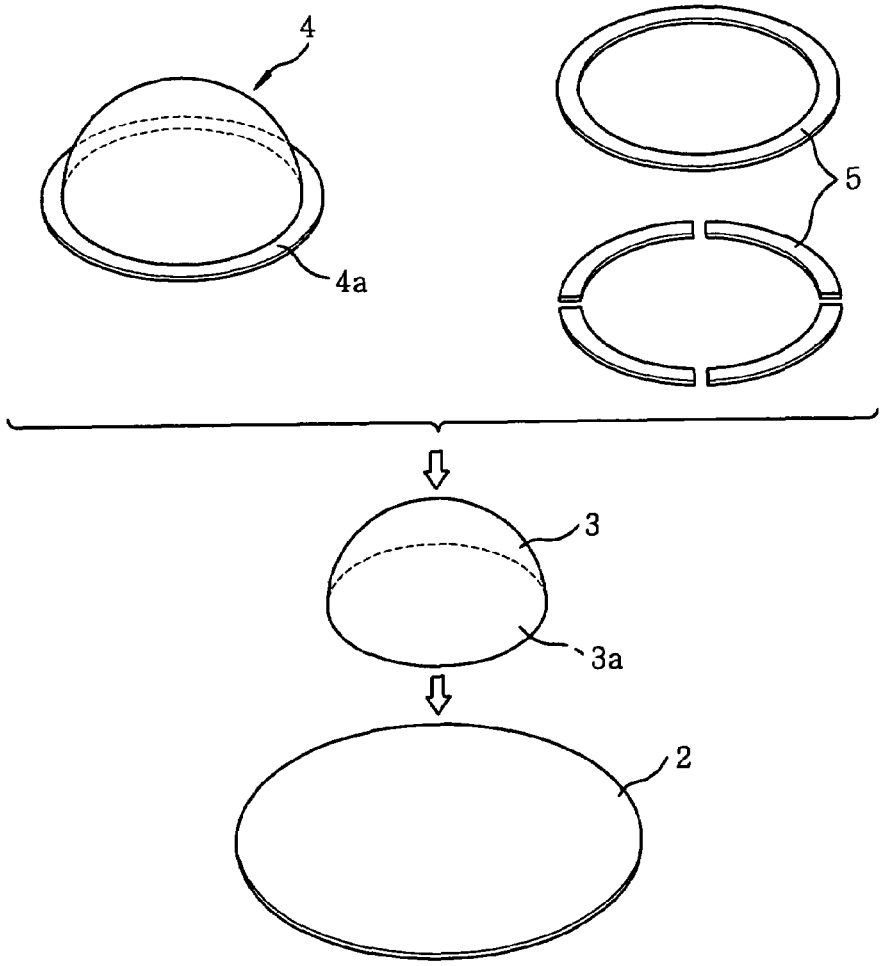
FIG. 2 is an exploded perspective view of a reflector, a Luneberg lens, a lens cover and a plate.

The reflector 2, the lens 3, the lens cover 4 and the plate 5 is shown in FIG. 2 in a disassembled state. The lens cover 4 to be used has a flange (external flange) 4*a* formed at the opening edge as a single body therewith.

The reflector 2 has a greater size than the lens 3. This reflector 2 may preferably be formed of aluminum that is lightweight and low-priced, but may also be formed as a metal plate other than aluminum or a resin plate whose surface is metal-plated. An outer region of the reflector 2 located out of an attaching region at which the lens cover 4 is attached may be formed as a porous metal plate with small-sized holes (e.g., holes with a diameter of 1 mm or less) or a metal mesh plate with small-sized holes (of, e.g., 1 mm or less). In short, a surface with a proper flatness not to disturb the reflection of radio wave would be sufficient as a radio wave reflection surface.

The lens 3 is conventionally manufactured by a method in which each part of the lens is divided into multi layers in a diametrical direction and the relative dielectric constant is made to vary slightly in each of the layers. It would be proper that the relative dielectric constant of the lens manufactured by the conventional method varies stepwise in the diametrical direction.

The lens cover 4 is formed of synthetic resin. Any kinds of synthetic resin may be used as long as it has a small dielectric loss and a sufficient weatherability. However, it would be preferable to use hydrocarbon-based thermoplastic resin such as polyethylene, polystyrene, and polypropylene, whose dielectric loss is noticeably small. Further, it would be preferred that the thickness of the lens cover 4 is less than or equal to 1 mm in terms of a reduction in dielectric loss.

The plate 5, although whose material is not particularly limited, may preferably be formed of aluminum that is lightweight and low-priced as the reflector 2. The plate 5 can be configured such that an upper surface thereof is made as a reflection surface of radio wave; or such that radio waves can transmit through the plate 5. In the former case, the plate 5 can be formed of a material same as the reflector 2. However, in the latter case, it is preferable to form the plate 5 with a material having a small dielectric loss, e.g., the same material as that of the lens cover 4. An endless ring is used as the plate 5. Alternatively, the ring is divided into two or more parts in the circumferential direction to be used as the plate 5.

The thickness of the plate 5 whose upper surface is used as a reflection surface for radio wave may preferably be smaller than or equal to 1/10 of the wavelength of a received radio wave. In case the plate 5 is arranged on the reflector 2, it is preferable that the plate 5 is made as thin as possible within a range in which a required strength is secured, thereby reducing a height (hereinafter, referred to as "step height") between the reflection surface of the reflector 2 and the upper surface of the plate 5 to be as small as possible. In this manner, adverse effects on the performance of the apparatus can be reduced. The step height may preferably be less than or equal to 1/10 of the wavelength of radio wave. With the structure as shown in FIGS. 9 to 12, the step height can be made small without reducing the thickness of the plate, so that the reflection surface of the reflector 2 can be aligned in the same plane as that of the upper surface of the plate 5. Details of the antennae shown in FIGS. 9 to 12 will be described later.

The primary feed 6, which is one referred to as an LNB (Low Noise Block), is provided at least one, and if necessary, plural in number to be positioned at the focal point of radio wave transmitted from, e.g., a geostationary satellite to communicate with.

The holding part 7 holds the primary feed 6 at the positioned point. As the holding part 7, it is possible to use well-known types of holder such as a pole bent along the surface of the lens or an arch-shaped arm.

In all of the radio wave lens antennae exemplified above, the flange 4*a* of the lens cover 4 is arranged between the reflector 2 and the plate 5 to fix the lens cover 4 to the reflector 2. Further, a sealing part 8 for sealing between the reflector 2 and the flange 4*a* is provided on a circumference whose diameter is greater than that of the lens, and the plate 5 is fixed to the reflector 2 by a clamping part 9 such as a bolt at a position spaced apart from the lens further than the sealing part 8.

Figure 3:
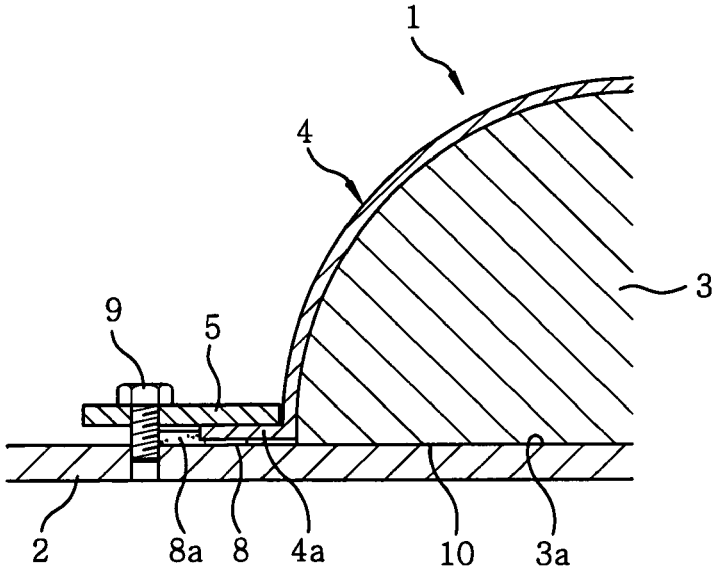
FIG. 3 is a cross sectional view showing a structure for fixing a lens to a lens cover in accordance with a first embodiment.
Figure 4:
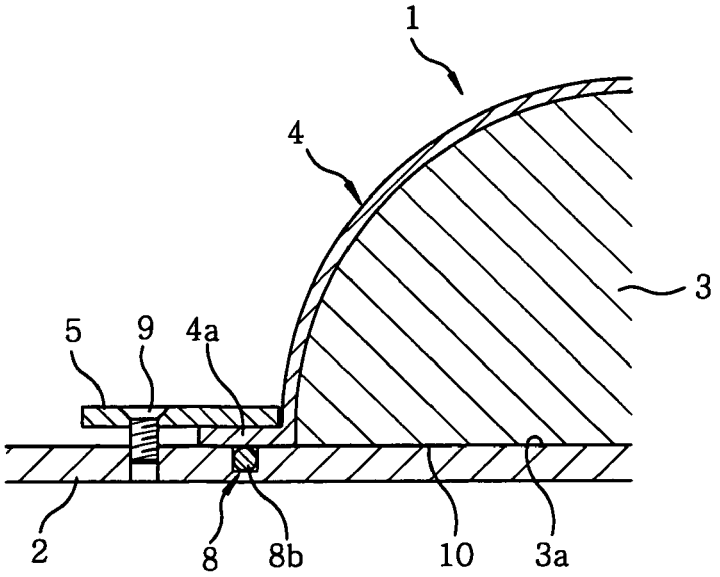
FIG. 4 is a cross sectional view showing a structure for fixing a lens to a lens cover in accordance with a second embodiment.

A first embodiment of a structure for fixing the lens cover 4 to the reflector 2 is shown in FIG. 3, and a second embodiment of that is depicted in FIG. 4. It is preferable that the lens 3 is adhesively fixed to the reflector 2, and, in the first and the second embodiment, the lens 3 is adhered onto the reflection surface of the reflector 2 by using an adhesive 10.

The hemispherical shell-shaped lens cover 4 is covered along the outer periphery of the lens 3, and the flange 4*a* formed at the opening edge of the lens cover 4 is attached onto the reflector 2. Then, the ring-shaped plate 5 is overlapped upon the flange 4*a* to be fixed to the reflector 2 by the clamping part 9, and the flange 4*a* is arranged between the plate 5 and the reflector 2 to fix the lens cover 4 to the reflector 2. Since at least a part of the lens cover 4 is in contact with the lens 3, the lens 3 is pressingly attached to the plate 2 via the lens cover 4, and, at the same time, the lens is fixed by the lens cover 4.

Further, in case of using the plate 5 divided into two or more parts in the circumferential direction such that the fixing position can be adjusted in the diametrical direction, the lens cover 4 can be pressed in the diametrical direction as well. By pressing the lens cover 4 in the diametrical direction as above, the lens 3 can be disposed diametrically between the divided parts of the plate 5 via the lens cover 4. Thus, even when a fixing surface 3*a* of the lens is detached and, in addition to this, the lens cover 4 is broken due to a deterioration of the adhesive 10, the lens 3 can be prevented from falling down by the clamping force of the plate 5.

In case of using the upper surface of the plate 5 as the reflection surface of radio wave, a flat head screw shown in FIG. 4 is preferable as the clamping part 9 in that it can maintain the upper surface of the plate 5 to be flat. However, other clamping elements, such as a rivet, may also be used as the clamping part 9.

It can be considered that the sealing part 8 is configured to use only a clamping pressure applied by the reflector 2 and the plate 5 onto two surfaces of the flange 4*a*. However, it is preferable that a sealing agent 8*a* such as a silicon coating agent, sealant, adhesive or the like, is coated on an interface between the sealing part 8 and the reflector 2 to thereby enhance the sealability. The enhancement in sealability can also be achieved by a method of bonding the flange 4*a* to the reflector by a double sided adhesive tape that is waterproof, or inserting an O-ring (or packing) 8*b* between the reflector 2 and the flange 4*a* as shown in FIG. 4.

Figure 5:
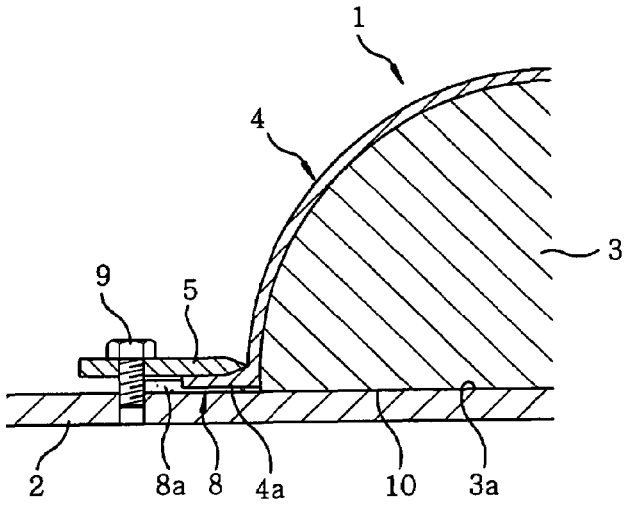
FIG. 5 is a cross sectional view showing a structure for fixing a lens to a lens cover in accordance with a third embodiment.
Figure 6A:
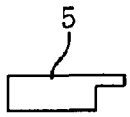
FIGS. 6A to 6I are cross sectional views showing modified examples of an inner peripheral part of the plate.
Figure 6B:
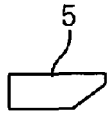
Figure 6C:
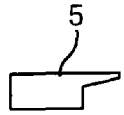
Figure 6D:
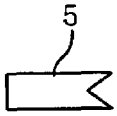
Figure 6E:
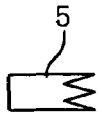
Figure 6F:
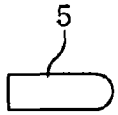
Figure 6G:
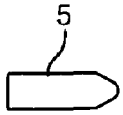
Figure 6H:
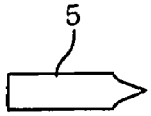
Figure 6I:
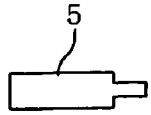

FIG. 5 illustrates a third embodiment of a structure for fixing the lens cover. The third embodiment differs from the first embodiment of FIG. 3 in that an inner peripheral surface of the plate 5 is sloped in such a direction that a separation gap between the inner peripheral surface and the lens 3 increases as moving towards the lower surface of the plate 5. Thus, a central portion (or an upper portion) of the peripheral surface in the thickness direction is formed to be projected, thereby enhancing the engageability of the plate 5 to the lens cover 4. It is preferable that an engaging part of the lens cover 4 engaged with the plate 5 is formed in a shape corresponding to that of the inner peripheral surface of the plate 5. In case of forming the inner peripheral surface of the plate 5 in a shape shown in FIG. 5 to be engagingly fixed to the lens cover 4, the problem that the lens cover 4 is displaced in the direction of the lens diameter to weaken the clamping force can be avoided.

The inner peripheral surface of the plate 5 may be formed in shapes as shown in FIGS. 6A to 6I, i.e., in a shape that the inner peripheral surface has at least one recessed or projected portion recessed or projected in the direction of the lens diameter such that the inner peripheral surface is fittedly inserted into the lens cover 4. The engageability to the lens cover 4 can be enhanced by this method as well.

Figure 7:
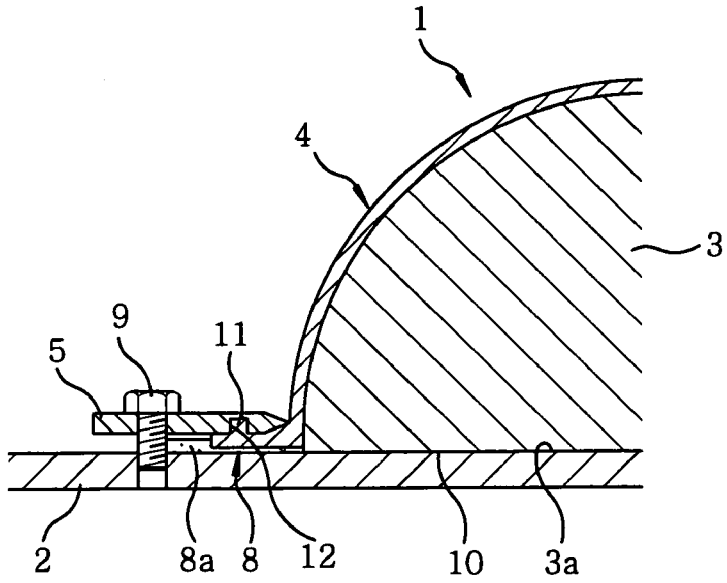
FIG. 7 is a cross sectional view showing a structure for fixing a lens to a lens cover in accordance with a fourth embodiment.
Figure 8:
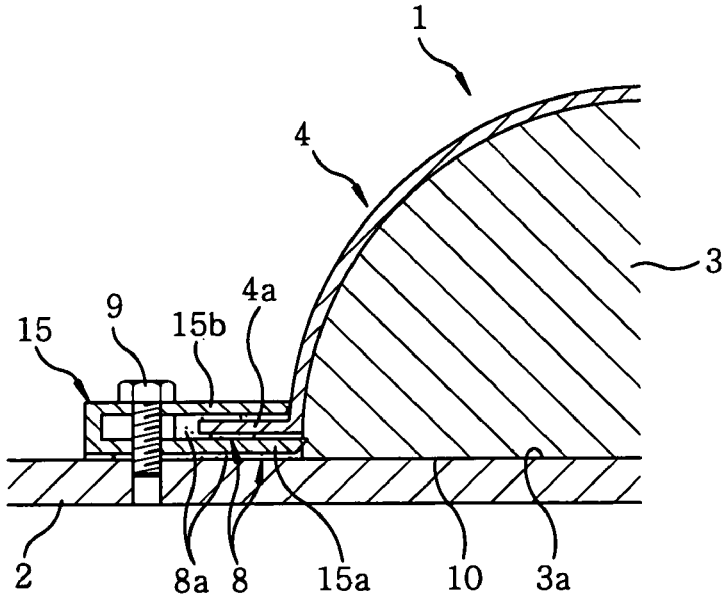
FIG. 8 is a cross sectional view showing a structure for fixing a lens to a lens cover in accordance with a fifth embodiment.

FIG. 7 illustrates a fourth embodiment of a structure for fixing the lens cover. In the fourth embodiment, a protrusion 11 and a groove 12 that fit each other are correspondingly formed on fitting surfaces of the plate 5 and the flange 4*a*. The protrusion 11 and the groove 12 are extended in a direction intersecting the diametrical direction of the lens, and the protrusion 11 and the groove 12 are engagingly fitted to prevent the flange 4*a* from moving in the direction of the lens diameter. Thus, the fixing force by the plate 5 is maintained without being weakened. Further, the same effect is also achieved in a structure where the protrusion 11 is formed on the plate 5 and engagingly fixed to the groove 12 on the lens cover 4.

FIGS. 8 to 12 illustrate fifth to ninth embodiments of a structure for fixing the lens and the lens cover. In the fifth embodiment shown in FIG. 8, the lens cover 4 is fixed to the reflector 2 by using a plate 15 which includes a lower plate 15*a* and an upper plate 15*b* such that a cross section thereof is U-shaped, and the plate 15 is divided into two or more parts in the circumferential direction. The lower plate 15*a* is sharpened at an upper edge of an inner periphery thereof by forming a tapered part at an inner peripheral surface thereof, and this sharpened edge is inserted into an outer circumference of the lens 3 at a vicinity of the fixing surface within an extent that does not affect the performance of the lens. Further, a flange 4*a* of the lens cover 4 is inserted between the lower plate 15*a* and the upper plate 15*b* that are clamped by the claming part 9 (which is a screw in the drawing), such that the flange 4*a* is held by the lower plate 15*a* and the upper plate 15*b* to thereby fix the lens cover 4 to the reflector 2. The structure of the fifth embodiment except the above is identical to that in the first embodiment shown in FIG. 3. In accordance with the fifth embodiment, the fixing of the lens is performed directly by the plate 5 as well as via the lens cover 4, so that the fixing of the lens is further stabilized.

Figure 9:
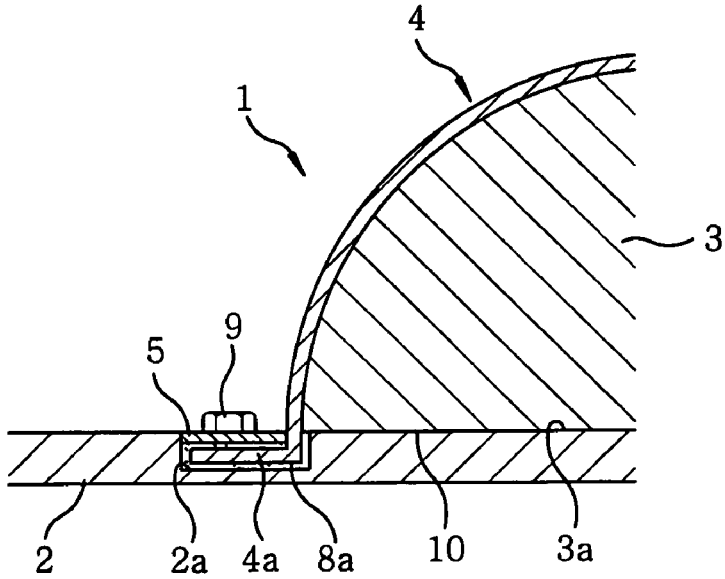
FIG. 9 is a cross sectional view showing a structure for fixing a lens to a lens cover in accordance with a sixth embodiment.

In the sixth embodiment of FIG. 9, a groove 2*a* that encircles the lens is formed at the reflector 2, in which the flange 4*a* at the opening edge of the lens cover 4 and the ring-shaped plate 5 are overlappingly accommodated. In this state, the plate 5 is buried in the reflector 2, and a reflection surface of the reflector 2 is aligned approximately in the same plane with the same height as an upper surface (reflection surface) of the plate 5. In this structure, although the plate 5 is used, a stepped potion is not formed on the reflection surface. Therefore, the electrical performance of the antenna would be better than a case where the stepped portion is formed. Further, since the flange 4*a* is buried in the reflector 2 and accordingly the sealing part 8 is also placed within the reflector 2, the sealing part can be properly formed without being affected by a recessed or a projected portion that might exist on the surface of the reflector.

Figure 10:
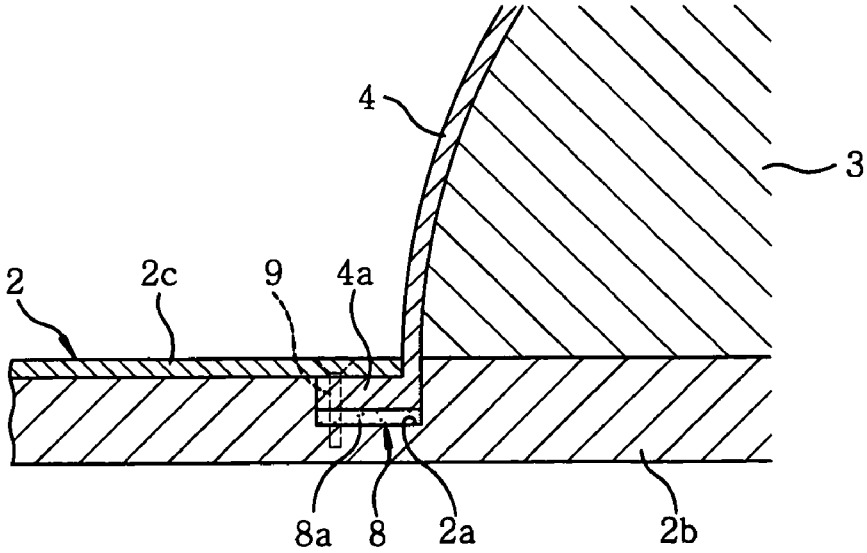
FIG. 10 is a cross sectional view showing a structure for fixing a lens to a lens cover in accordance with a seventh embodiment.
Figure 11:
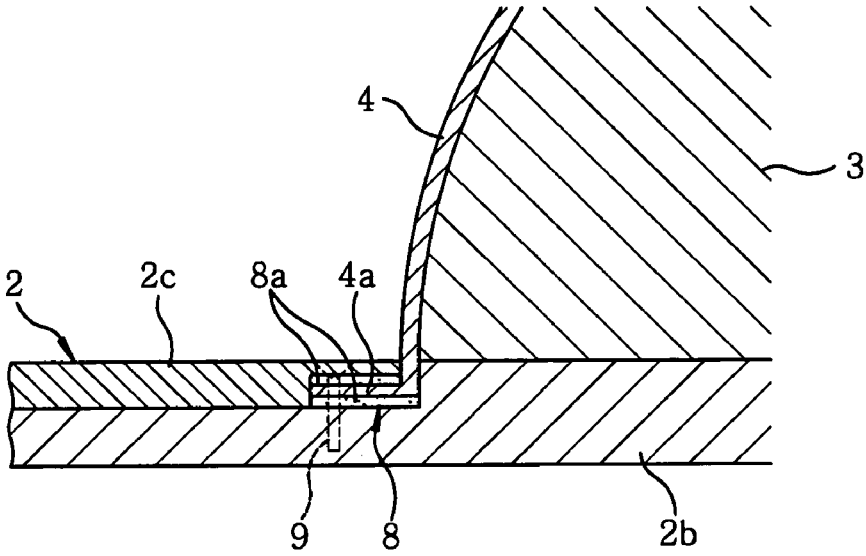
FIG. 11 is a cross sectional view showing a structure for fixing a lens to a lens cover in accordance with an eighth embodiment.
Figure 12:
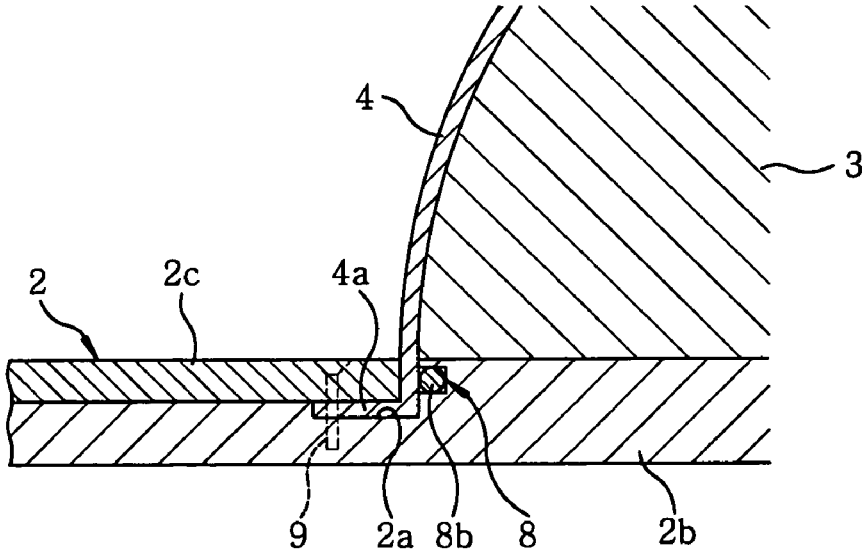
FIG. 12 is a cross sectional view showing a structure for fixing a lens to a lens cover in accordance with a ninth embodiment.

In the seventh to ninth embodiments shown in FIGS. 10 to 12, the reflector 2 is configured to include a first reflector 2*b* on which the lens 3 is mounted, and a second reflector 2*c* covering a part of the first reflector 2*b* that encircles the lens 3. The thickness of the first reflector 2*b* is made smaller at an outer part located out of the outer diameter of the lens cover 4 than at an inner part on which the lens 3 is attached to thereby form a stepped portion on an upper surface of the first reflector 2*b*, wherein the difference in the thickness between the above-mentioned parts of the first reflector 2*b* is equivalent to the thickness of the second reflector 2*c*. The second reflector 2*c* is placed to cover the outer part where the thickness of the first reflector 2*b* is smaller such that an upper surface of the first reflector 2*b* is aligned in the same plane as that of the second reflector 2*c*. The second reflector 2*c* has a circular hole for accommodating the lens cover 4, and therefore its shape is not exactly a circular ring, but it would be possible to regard it as a ring. In the present embodiment, this second reflector 2*c* is also regarded as a ring-shaped plate.

With this structure, the first reflector 2*b* serves as a pressing plate to fix the flange 4*a* of the lens cover arranged between the first reflector 2*b* and the second reflector 2*c*. Thus, there is no need to prepare an additional plate for pressing the flange 4*a*. In addition, in the same manner as the sixth embodiment shown in FIG. 9, the sealing part 8 is placed within the reflector. Thus, the sealing part can be properly formed without being affected by a recessed or a projected portion that might exist on the surface of the reflector.

Further, whereas a groove is formed on the first reflector 2*b* to provide an accommodating space for the flange 4*a* in the seventh embodiment shown in FIG. 10, the accommodating space for the flange 4*a* may also be provided by forming a stepped portion on a lower surface of the second reflector 2*c* as in the eighth embodiment shown in FIG. 11. Further, in case of placing the flange 4*a* within the reflector 2, it may be possible to form the sealing part 8 between the reflector and an inner surface near the opening edge of the lens cover 4 as in the ninth embodiment shown in FIG. 12.

Figure 13:
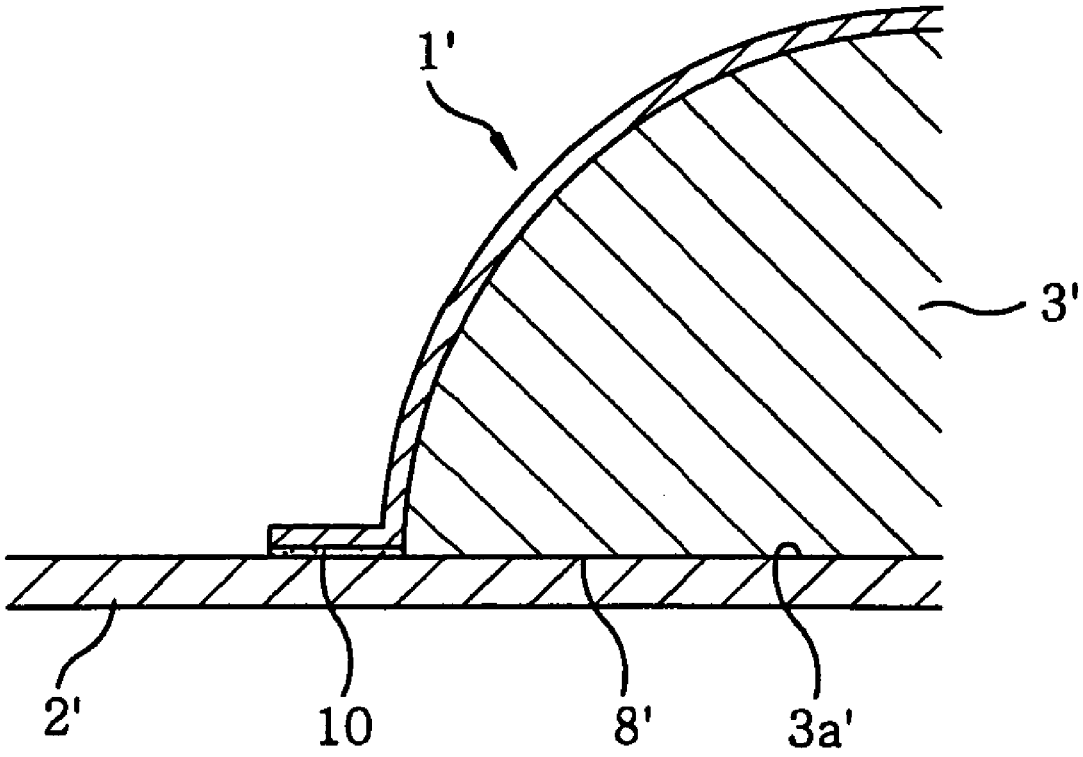
FIG. 13 (PRIOR ART)
FIG. 13 is a cross sectional view of a conventional structure for fixing a lens to a lens cover only by adhesion.

FIG. 13 schematically shows a conventional radio wave lens antenna in which a lens 3' and a lens cover 4' are fixed on a reflector 2' only by an adhesive 10. In order to evaluate the reliability of lens fixing in the conventional radio wave lens antenna and the radio wave lens antennae using the fixing structures of the first to ninth embodiments, the electric characteristics were examined by sloping the antenna apparatus at the degree from 0° to 90°, i.e., until the reflector 2' turned into a vertical state starting from a horizontal state. As the result, in the conventional case, the fixing of the lens was unstable, and a misalignment of the lens occurred on the reflector, which caused to decrease the receiver sensitivity C/N by 1.1 dB. In comparison, it was verified that, in the first to ninth embodiments, the receiver sensitivity for radio wave remained unchanged, and the fixing of the lens 3 was stable by placing the flange between the ring-shaped plate and the reflector to fix the lens cover to the reflector.

What is claimed is:

1. A radio wave lens antenna comprising: a hemispherical Luneberg lens; a lens cover that covers the surface of the lens; a reflector for radio wave combined with the lens; a ring-shaped plate arranged along an outer circumference of the lens; a primary feed arranged at a focal point of the lens; and a holding part for the primary feed, wherein the lens cover is fixed by arranging a flange formed at an opening edge thereof between the reflector and the plate, a sealing part that seals between the reflector and the flange is provided on a circumference centered at a center of the lens and having a diameter greater than that of the lens, and the plate is fixed to the reflector at a position located farther from the lens than the sealing part.

2. The radio wave lens antenna of claim 1, wherein the plate is divided into two or more parts in a circumferential direction.

3. The radio wave lens antenna of claim 1, wherein a part of the lens cover is brought in contact with the lens to fix the lens.

4. The radio wave lens antenna of claim 2, wherein a part of the lens cover is brought in contact with the lens to fix the lens.

5. The radio wave lens antenna of claim 1, wherein an inner peripheral surface of the plate is sloped in a direction that a separation gap from the lens increases as moving towards a lower surface of the plate.

6. The radio wave lens antenna of claim 1, wherein an inner peripheral surface of the plate has a recessed or a projected portion recessed or projected in a direction of a lens diameter, and the inner peripheral surface of the plate is fittedly inserted to the lens cover.

7. The radio wave lens antenna of claim 3, wherein a thickness of the plate is less than or equal to 1/10 of a wavelength of a received radio wave.

8. The radio wave lens antenna of claim 4, wherein a thickness of the plate is less than or equal to 1/10 of a wavelength of a received radio wave.

9. The radio wave lens antenna of claim 1, wherein an upper surface of the plate is maintained to be flat by clamping the plate to the reflector by a flat head screw.

10. The radio wave lens antenna of claim 1, wherein the plate is formed of synthetic resin having a low dielectric loss, and a reflection surface of the reflector is placed under the plate.

11. The radio wave lens antenna of claim 1, wherein the plate is buried in the reflector to reduce a step height between the plate and the reflector.

12. The radio wave lens antenna of claim 1, wherein the reflector includes a first reflector on which the lens is mounted and a second reflector covering a part of the first reflector that encircles the lens, and the second reflector is also used as the plate.

13. The radio wave lens antenna of claim 2, wherein the reflector includes a first reflector on which the lens is mounted and a second reflector covering a part of the first reflector that encircles the lens, and the second reflector is also used as the plate.

14. The radio wave lens antenna of claim 3, wherein the reflector includes a first reflector on which the lens is mounted and a second reflector covering a part of the first reflector that encircles the lens, and the second reflector is also used as the plate.

15. The radio wave lens antenna of claim 4, wherein the reflector includes a first reflector on which the lens is mounted and a second reflector covering a part of the first reflector that encircles the lens, and the second reflector is also used as the plate.

16. The radio wave lens antenna of claim 5, wherein any of an O-ring, a packing, a sealant, and an adhesive are used separately or in combination as a sealing agent of the sealing part.

17. The radio wave lens antenna of claim 12, wherein any of an O-ring, a packing, a sealant, and an adhesive are used separately or in combination as a sealing agent of the sealing part.

18. The radio wave lens antenna of claim 13, wherein any of an O-ring, a packing, a sealant, and an adhesive are used separately or in combination as a sealing agent of the sealing part.

19. The radio wave lens antenna of claim 14, wherein any of an O-ring, a packing, a sealant, and an adhesive are used separately or in combination as a sealing agent of the sealing part.

20. The radio wave lens antenna of claim 15, wherein any of an O-ring, a packing, a sealant, and an adhesive are used separately or in combination as a sealing agent of the sealing part.

* * * * *